US007917972B1

(12) United States Patent
Krueger

(10) Patent No.: US 7,917,972 B1
(45) Date of Patent: Apr. 5, 2011

(54) INFLATABLE AIR RECOIL SUPPRESSOR

(75) Inventor: Wesley W. O. Krueger, San Antonio, TX (US)

(73) Assignee: Body Armour Technology, LLC, San Antonio, TX (US)

( * ) Notice: Subject to any disclaimer, the term of this patent is extended or adjusted under 35 U.S.C. 154(b) by 912 days.

(21) Appl. No.: 11/828,326

(22) Filed: Jul. 25, 2007

(51) Int. Cl.
*A41D 13/00* (2006.01)

(52) U.S. Cl. ..... 2/459

(58) Field of Classification Search ..... 2/16, 455, 2/94, 267, 412, 69, 108, DIG. 3, 459
See application file for complete search history.

(56) References Cited

U.S. PATENT DOCUMENTS

| | | | | | |
|---|---|---|---|---|---|
| 1,587,946 | A | * | 6/1926 | Gibson | 2/459 |
| 1,774,060 | A | | 8/1930 | Hodge | |
| 2,438,142 | A | | 3/1948 | Brower | |
| 3,257,666 | A | * | 6/1966 | Hoffman | 2/459 |
| 3,872,511 | A | * | 3/1975 | Nichols | 2/413 |
| 4,353,133 | A | * | 10/1982 | Williams | 2/459 |
| 4,375,108 | A | * | 3/1983 | Gooding | 2/413 |
| 4,493,115 | A | * | 1/1985 | Maier et al. | 2/459 |
| 4,922,641 | A | | 5/1990 | Johnson | |
| 5,095,545 | A | * | 3/1992 | Lane | 2/68 |
| 5,265,366 | A | | 11/1993 | Thompson | |
| 5,375,360 | A | | 12/1994 | Vatterott | |
| 5,461,813 | A | | 10/1995 | Mazzola | |
| 6,257,562 | B1 | | 7/2001 | Takashima et al. | |
| 6,453,477 | B1 | | 9/2002 | Bainbridge et al. | |
| 6,588,023 | B1 | * | 7/2003 | Wright | 2/459 |
| 6,684,547 | B2 | | 2/2004 | Poff, Jr. | |
| 6,758,466 | B2 | | 7/2004 | Russell | |
| 6,834,456 | B2 | | 12/2004 | Murello | |
| 6,976,333 | B2 | | 12/2005 | Sims | |
| 7,055,277 | B2 | | 6/2006 | Sims | |
| 7,082,621 | B1 | | 8/2006 | Fratesi | |
| 7,152,356 | B2 | | 12/2006 | Sims | |
| 7,168,104 | B2 | | 1/2007 | Tobergte | |
| 7,232,118 | B2 | | 6/2007 | Maeno et al. | |
| 7,376,978 | B2 | | 5/2008 | Godshaw | |
| 2006/0254112 | A1 | | 11/2006 | Snoderly | |

OTHER PUBLICATIONS

Chiara Daraio, Vitalif F. Nesterenko, and Sungho Jin. "Impact response by a foamlike forest of coiled carbon nanotubes": Journal of Applied Physics 100, (2006) 064309-1-06309-4 (American Institute of Physics). Downloaded Apr. 16, 2007 to 130.127.189.238. Redistribution subject to API license or copyright, see http://jap.aip.org/jap/copyright.jsp.

* cited by examiner

*Primary Examiner* — Tejash Patel
(74) *Attorney, Agent, or Firm* — Douglas W. Rommelmann; Andrews Kurth LLP

(57) ABSTRACT

An inflatable and adjustable shock absorption system including a shock absorption unit with interacting, force-dispersing dimple arrays and an intervening, reversibly inflatable air bladder.

23 Claims, 7 Drawing Sheets

INFLATABLE AIR RECOIL SUPPRESSOR

BACKGROUND OF THE INVENTION

1. Field of the Invention

The present invention relates to accessories for firearms, or accessories for hunters and shooters, and more specifically to devices that dampen the recoil effects of a discharging firearm.

2. Background Information

When a firearm is discharged, there is a "kick," or recoil. Recoil is the backward kick or force produced by a gun upon discharge. The inevitable recoil is equal to the derivative of the backward momentum resulting upon discharge.

Recoil of a firearm has been associated with poor shooting ability because of flinching. In other words, the way in which the shooter anticipates, perceives and compensates the shock or pain of recoil can have a significant impact on the shooter's experience and performance. It may also lead to a loss of the desire to shoot larger firearms, which may be more effective for certain purposes. So, if a gun "kicks like a mule," then the shooter may approach a firearm with too much caution, as he or she will anticipate the recoil and overcompensate as the shot is being fired. This overcompensation may manifest as a jerking motion that can disturb the alignment of the gun and result in a miss.

This perception of recoil is related to the momentum associated with a particular gun. The total force of recoil is associated with the momentum of a gun. This momentum is the product of the firearm's mass and the backwards (recoil) velocity of the gun. Therefore, for a given load, a heavier firearm, i.e., a gun with more mass, will have less momentum upon firing and be directly perceived as having a smaller recoil. Reducing the initial jolt, the rate and/or extent of rearward displacement, and/or any internal impacts in the operating parts of a firearm can reduce the shooter's perception of recoil and may also work to extend the life of the mechanism and its parts.

In an attempt to control or lessen the felt recoil, manufacturers employ different techniques and technologies. A recoil buffer or arrestor is a factory-installed or aftermarket component of firearms, which serves to reduce the velocity of and/or cushion the impact of recoiling parts of a firearm. The simplest form is just a type or variation of resilient/deformable material, like leather pads, gel pads, closed cell foam pads, the rubber butt pad of a shotgun, recoil pads mounted on stocks, or the newer "Navcom" (Noise and Vibration Control Material) shoulder pads. With closed cell foam systems the recoil simply "imprints" the pads in a very localized area, and although the recoil is softened, it still results in "felt recoil" in a very confined region. The gel, leather and Navcom pads have similar problems reducing recoil, and are still inadequate in dissipating the recoil energy as they cannot effectively disperse it broadly.

Another means to control or lessen the felt recoil is via muzzle breaks on the end of a barrel, which can increase the harmful decibel levels by approximately 30%. Such a dramatic acoustic concussion can cause hearing loss to the shooter and to those in the vicinity. In fact, a PH or Guide would prefer that a hunter not arrive in camp with a recoil arrestor on the barrel, which can cause tinnitus, if not permanent hearing loss.

3. Background Art

Current devices or pads are inadequate at effectively dampening recoil, or widely dispersing the recoil, or limited in their scope of application. U.S. Pat. No. 6,257,562, entitled "Liquid filled vibration isolating device" and issued to Takashima on Jul. 10, 2001, is a liquid filled vibration isolating device which is mainly used for supporting a vibration generating body. Significantly, the '562 patent uses a liquid filled device to support an engine or other vibrating part of the automobile, in order to separate the vibration from other components such as the transmission or body of the vehicle.

U.S. Patent Appln. Pub. No. 2006/0254112, entitled "Double air valve recoil dampener for firearms" and filed by Snoderly on May 13, 2005, is a device that uses a dual piston system mounted on the butt section of a firearm. As the gun discharges, the recoil allows air to escape from the holes in the bottom of each cylinder. Significantly, the proposed invention is not mounted on the stock, but worn on the body and utilizes a different method of dissipation of the energy force. In the Snoderly application, the force is still directly in line with the butt section of the stock dampener.

U.S. Pat. No. 7,152,356 ("the '356 patent"), entitled "Recoil reducing accessories for firearms" and issued to Sims on Dec. 26, 2006, is a firearm accessory that uses a pad on the shoulder of the shooter made of a viscoelastic material and a complementary component mounted on the butt section of the stock of the gun. It also utilizes a mushroom-like configuration defined by a head and stem, which can move in 360 degrees to dampen the recoil. Their "pneumatic compression" is in sealed compartments and are not adjustable. The elastomeric pad on the shoulder only cushions the impact by elastic compression of small stems, which are free to move 360 degrees. One major drawback of this type of design is that it maintains the impact still in line with the butt section of the stock. In other words, it will imprint the recoil in line with the stock on the shooter's shoulder.

U.S. Pat. No. 7,055,277 B2, entitled "Recoil reducing accessories for firearms" and issued to Sims on Jun. 6, 2006, is similar to the '356 patent. Also, U.S. Pat. No. 6,976,333, entitled "Recoil reducing accessories for firearms" and issued to Sims on Dec. 20, 2005 is similar to the '356 patent.

U.S. Pat. No. 6,758,466 ("the '466 patent") is entitled "Fluid-elastomeric damper assembly including internal pumping mechanism" and issued to Russell on Jul. 6, 2004. The mechanical properties, materials, and intent for use of the '466 patent are different than the proposed invention. The '466 patent uses fluid to reduce motion between two structures, such as the moveable rotor and body of an aircraft.

U.S. Pat. No. 6,684,547, entitled "Firearm recoil dampening assembly" and issued to Poff on Feb. 3, 2004, uses a recoil reduction system related to the bolt and stock. It specifically utilizes shock absorbers and spacers between the bolt and stock. It is therefore not worn like the proposed invention and utilizes a totally different technology.

U.S. Pat. No. 5,461,813 ("the '813 patent"), entitled "Air coil" and issued to Mazzola on Oct. 31, 1995, is a recoil pad for a shoulder gun such as a rifle or shotgun having a compressible pad on the butt of the stock to absorb and cushion the shock to the shooter when the gun is fired. Specifically, this patent utilizes a recoil pad attached to the butt section of the stock and uses elastomeric material and a closed-cell-foam containing an air, fluid, or gas. One embodiment includes a bladder and pump for inflation of the recoil pad at the will of the shooter. However, the pad of this '813 patent will still "imprint" the shoulder in the dimensions of the stock as it contacts the skin.

U.S. Pat. No. 7,232,118, entitled "Fluid filled vibration damping device" and issued to Maeno on Jun. 19, 2007, is a fluid filled vibration-damping device that includes an elastic body disposed between a first mounting member and a second mounting member and partially defines a fluid chamber having a non-compressible fluid sealed therein. This patent exhibits vibration damping action on the basis of flow action of the non-compressible fluid created within the fluid chamber during vibration input.

U.S. Pat. No. 4,922,641, entitled "Recoil pad" and issued to Johnson on May 8, 1990, is an improved recoil pad for attachment to the butt end of a firearm's stock. A series of springs, preferably helical, are utilized to reduce the transfer of recoil energy to the shooter. Interior air is released through air channels to reduce the forces opposing compression of the recoil pad. Further, the pad utilizes compressible foam to aid in overall compressibility.

U.S. Pat. No. 5,265,366, entitled "Foam recoil pad for firearms" and issued to Thompson on Nov. 30, 1993, is a recoil pad for attachment to a firearm buttstock of the type having a retaining sleeve and an end wall that communicate to form a unitary boot. The sleeve and wall are constructed of similar density foam material, so as to absorb recoil upon the discharge of the firearm. The predetermined exterior dimension of the unitary boot is substantially larger than the dimension of rifle buttstock. This increased area allows the pad to disperse recoil impact more effectively.

U.S. Pat. No. 1,774,060 ("the '060 patent"), entitled "Firearm cushion" and issued to Hodge on Aug. 26, 1930, is a firearm cushion adapted to function as a shock absorber. Significantly, the '060 patent uses a cap or sleeve attached to the butt section of a firearm stock. There is a pneumatic chamber in the sleeve which allows air to be inserted with a needle. Upon withdrawal of the needle the opening formed automatically closes.

U.S. Pat. No. 6,834,456, entitled "Recoil pad device" and issued to Murello on Dec. 28, 2004, is a recoil pad device that includes a pad having a working surface that increases by more than approximately 15% when moving from a first condition in which the pad is pressed against a shooter and a second condition when the firearm is fired.

U.S. Pat. No. 2,438,142, entitled "Air cushion for gun stocks" and issued to Brower on Mar. 23, 1948, uses a pad placed on the butt section of a firearm stock. Air is compressed out of the tubes or "valves" as the gun recoils.

U.S. Pat. No. 5,375,360, entitled "Cushioned shoulder pad for rifle or shotgun" and issued to Vatterott on Dec. 27, 1994, uses a recoil pad fitted to the butt section of a firearm and another pad pressed against a shoulder of the shooter. The pads "interfit" with each other. When the gun discharges, a seal is effected between the pads and the air is compressed. This causes a cushioning effect, compressing the springs. Eventually the pad members return to their original position after the recoil.

However, to date, no pad or device both effectively dampens the recoil and widely disperses the recoil via a device that can be readily inflated into the pad to any desired degree. There is a need in the art for a recoil suppressor that can be utilized and adjusted for a variety of recoil-sensitive users, types or calibers of firearms, and frequency and type of shooting.

SUMMARY OF THE INVENTION

In view of the foregoing, it is an object of the present invention to provide an improved firearm accessory.

It is another object of the present invention to provide an improved air recoil suppressor that is inflatable.

It is another object of the present invention to provide an improved air recoil suppressor using an outer low density polyethylene material and middle inflatable air system.

It is another object of the present invention to provide an improved air recoil suppressor that can have variable inflation or deflation, depending on the need.

It is another object of the present invention to provide an improved, inflatable and adjustable air recoil suppressor that both dampens recoil associated with a firearm discharge and disperses the recoil.

It is another object of the present invention to provide a single, improved, inflatable and adjustable air recoil suppressor that can accommodate recoil sensitivity for a variety of users.

It is another object of the present invention to provide a single, improved, inflatable and adjustable air recoil suppressor that can accommodate a variety of calibers or weapon selections.

It is another object of the present invention to provide a single, improved, inflatable and adjustable air recoil suppressor that can accommodate the user volume and type of shooting.

It is another object of the present invention to provide a single, improved, inflatable and adjustable air recoil suppressor that can be fitted into any vest, shirt, jacket, or vest-like garment.

It is another object of the present invention to provide a single, improved, inflatable and adjustable air recoil suppressor that can help the shooter avoid flinching.

It is another object of the present invention to provide a single, improved, inflatable and adjustable air recoil suppressor that can improve shot placement.

In one aspect of the present technology, the internal circular material, which is very rigid and made of a low density polyethylene material with "memory," makes contact with each other at the apex or top of the opposing circle to spread the impact 360 degrees from the point of the impact. Thus, this inflatable air system can be utilized and adjusted for a variety of recoil-sensitive users, the type of caliber or weapon selection, and the user volume and type of shooting.

The inflatable air recoil suppressor of the present invention uses a uniquely designed outer low density polyethylene material and middle inflatable air system, which can be varied by the amount of air in the system depending on the need. The design and construction of the outer shell provide some rigidity and disperses the recoil by the internal dimples or circles, which if contacted with the opposing apex of the other internal dimple, will spread the recoil. It also has some "memory" and will return to its preformed shape after the recoil occurs. Specifically, by inflating the device with air or deflating some of the air in the device, the shooter or user can make the necessary adjustments with air pressure of his or her preference. The present invention not only dampens the recoil, but also widely disperses the recoil compared to the other products. The air can be inflated into the pad to the necessary degree, depending on the recoil sensitivity of the user, the caliber or weapon selection, volume or type of shooting.

DETAILED DESCRIPTION OF THE PREFERRED EMBODIMENT

Figure 1:
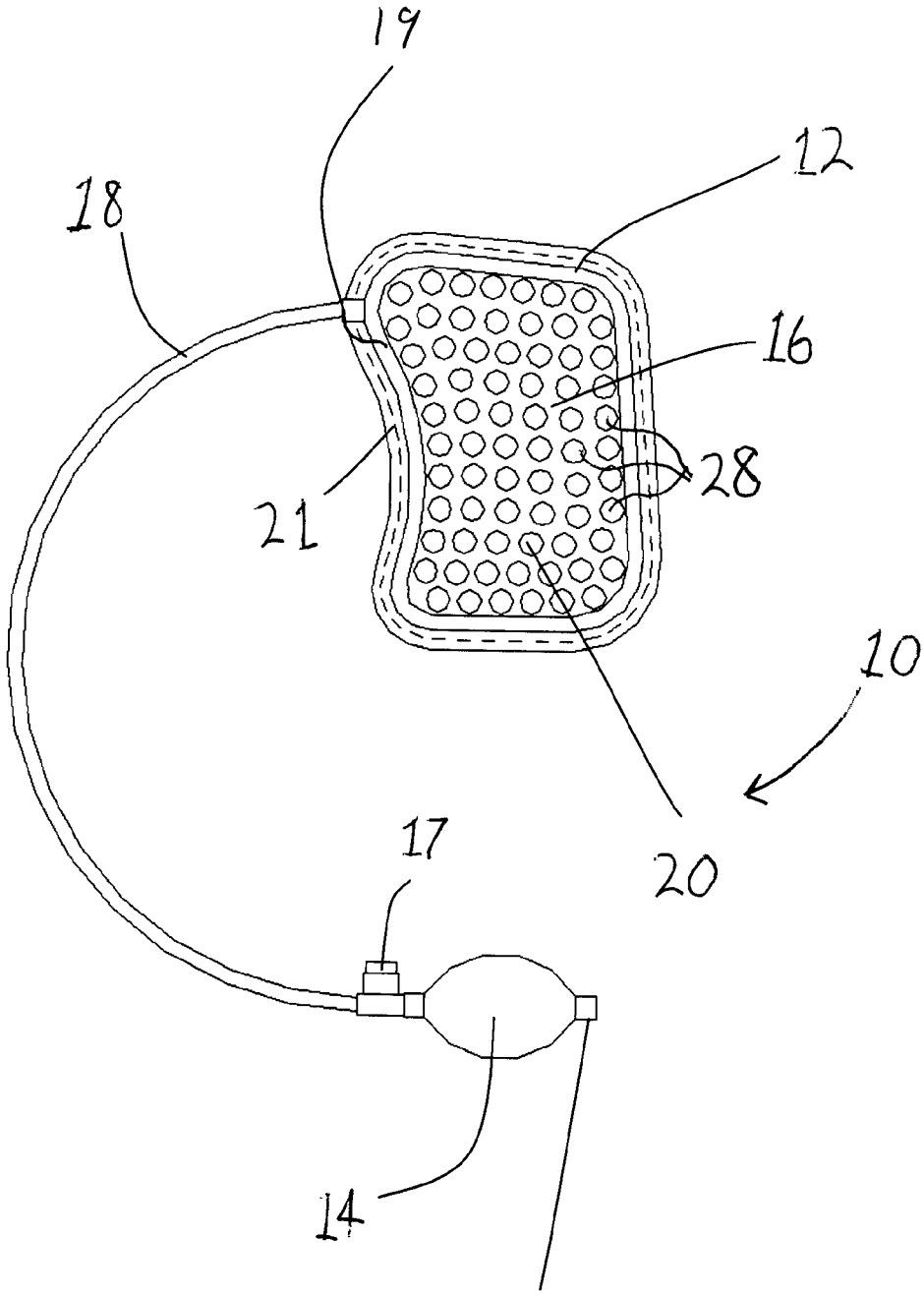
FIG. 1 is a front, perspective view of the present invention.
Figure 2:
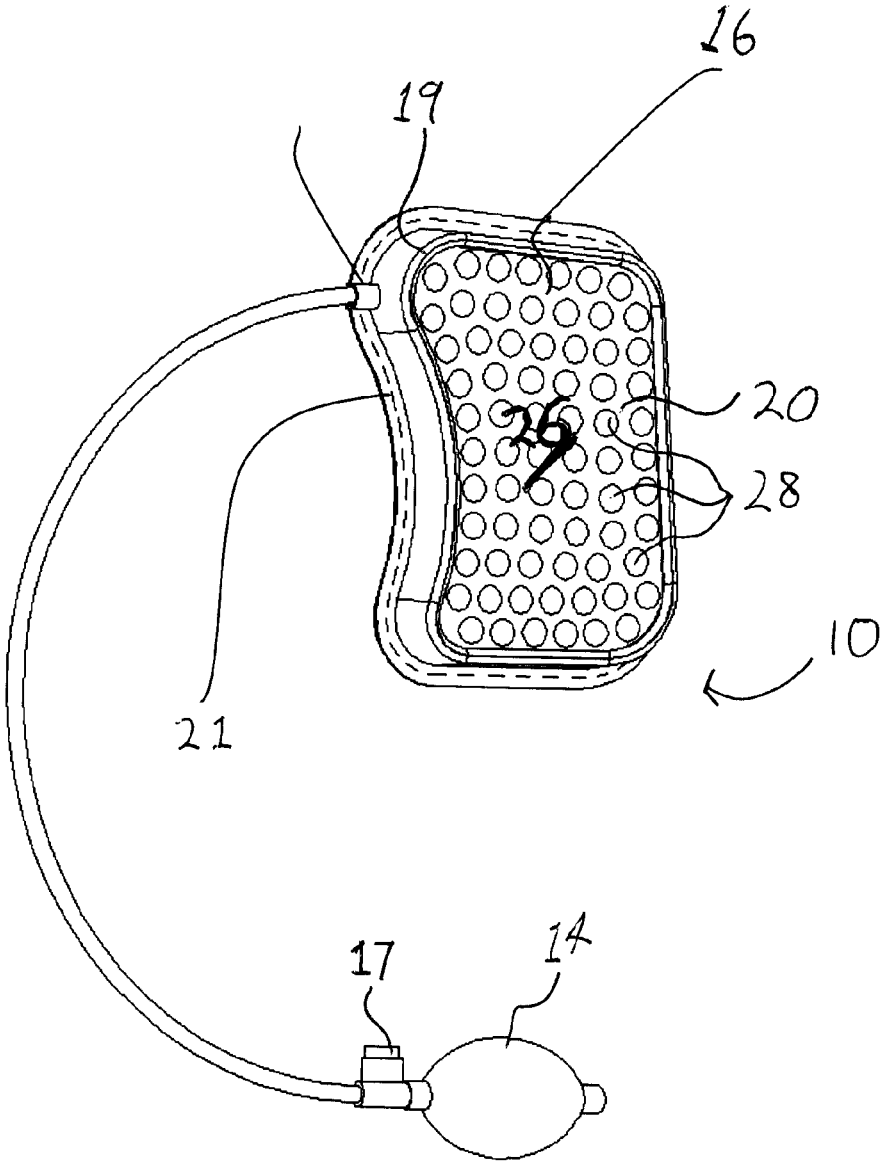
FIG. 2 is a back, perspective view of the present invention.

Referring principally to FIGS. 1 and 2, the presently-envisioned recoil suppression system of the present invention is identified generally by the reference number 10. Recoil suppression system 10 includes a recoil suppression unit 12, a pump 14, and (in the case of a separate pump, as is shown in the preferred embodiment), a conduit 18 which integrates recoil suppression unit 12 and pump 14.

In the depicted embodiment, pump 14 is shown as the type most commonly seen in use with a sphygmomanometer (blood pressure cuff). However, it should be understood that alternative pumps may be substituted. Alternatives include (but are not limited to) other, manual pumps, such as is integrated into modern day basket balls, and which "pop up" for inflating operations, but which recesses into the ball between uses. Also, electric, preferably battery-powered air pumps may be used.

Figure 3:
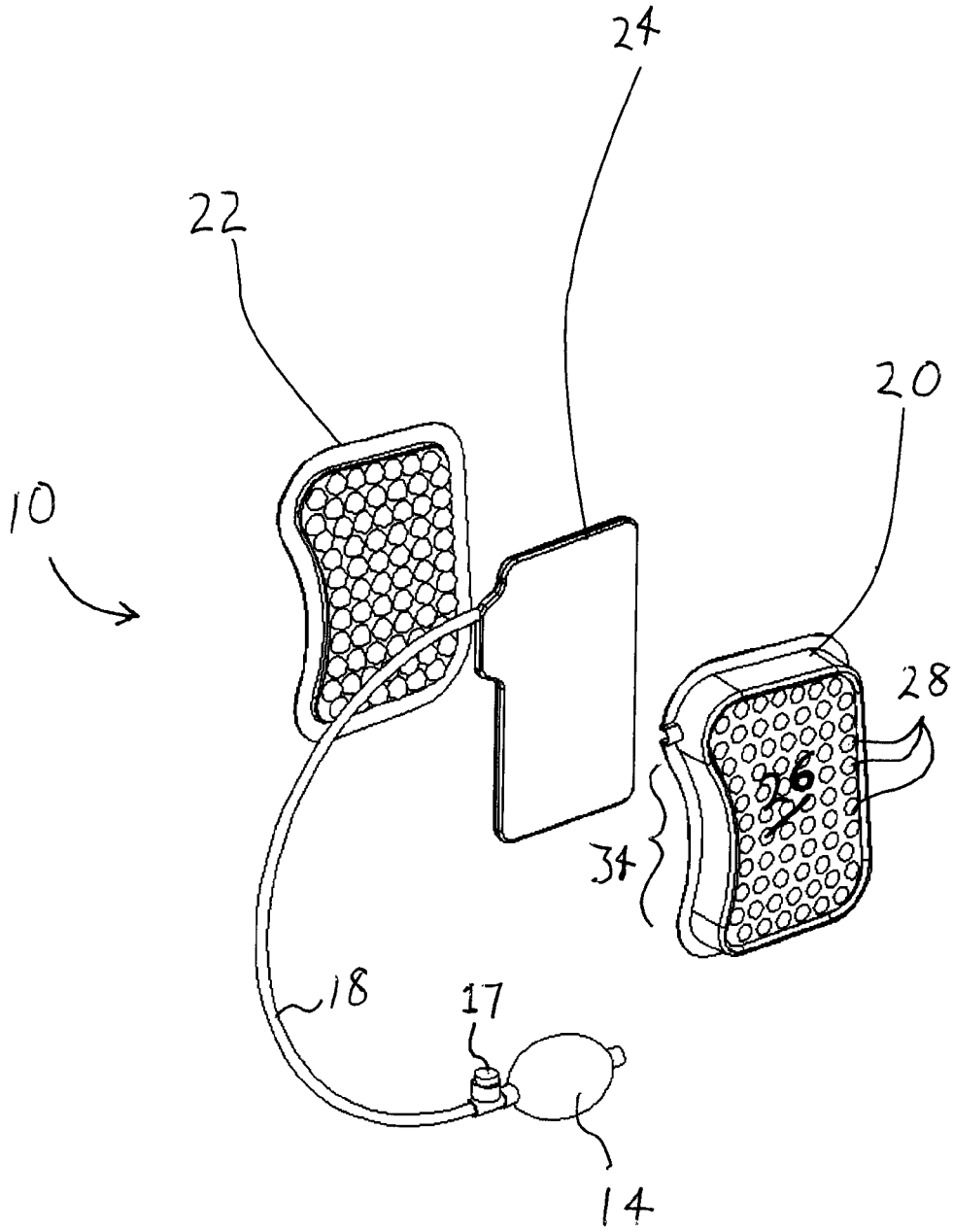
FIG. 3 is an exploded perspective view of the present invention.

Referring to FIGS. 1-3, recoil suppression unit 12 includes an outer shell member 16. Shell member 16 is, in the preferred embodiment, constructed of low density polyethylene material, of approximately 0.02 (thin point at bottom of each dimple) to 0.04 (thickest point) inch in thickness. This material selection imparts a desirable balance between flexibility for shock absorption purposes and force distribution purposes, and resilience (or "memory") for returning to a pre-use configuration between uses. Alternative materials may be used, provided they exhibit similar stiffness, memory and resiliency.

Shell member 16 is, in the depicted embodiment, made from two complimentary, front and rear shell halves 20 and 22 (joined at their respective peripheries by mechanical, thermal or chemical means). It should be noted, however, that shell member 16 may be injection or blow-molded in alternative embodiments, so long as provisions are made for defining the interior space for, and encasing the embedded, to-be-discussed internal air bladder 24 therein.

An air bladder member 24 resides within, and substantially fills the interior space of shell member 16. Bladder member 24 is in sealed fluid communication with pump 14 by way of conduit 18. A valve 17 allows the user to manually adjust the bladder air pressure, as needed or desired.

The shallow (back) shell half 22 of shell member 16 is a thin flexible piece that is to be placed in contact with a user's shoulder area (or other bodily structure that is to be protected from recoil trauma). The deep (front) shell half 20 of shell member 16 provides the interior volume needed to define the shell's interior face for housing air bladder member 24 (if the air bladder is included, as in the preferred embodiment).

Shell member 16 is molded to include structural ribbing 19 which maintains shell member 16's somewhat rigid shape and defines the edges of the shock (rifle recoil) absorbing area 26.

When, as an example, recoil suppression system 10 is used with a rifle or shotgun, the shock absorbing area 26 of shell member 16 contacts the firearm's stock when it is in position for firing. This area 26 deflects to absorb and dampen shock (which is also transmitted to bladder member 24—to be discussed in more detail below).

Figure 4:
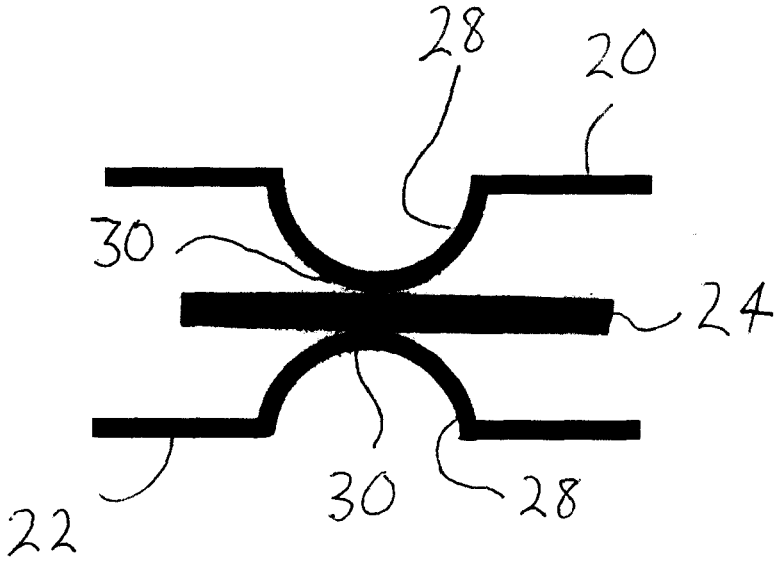
FIG. 4 is a cross sectional view of the shock absorption unit 12 of FIGS. 1-3, at a resting or deflated configuration.
Figure 5:
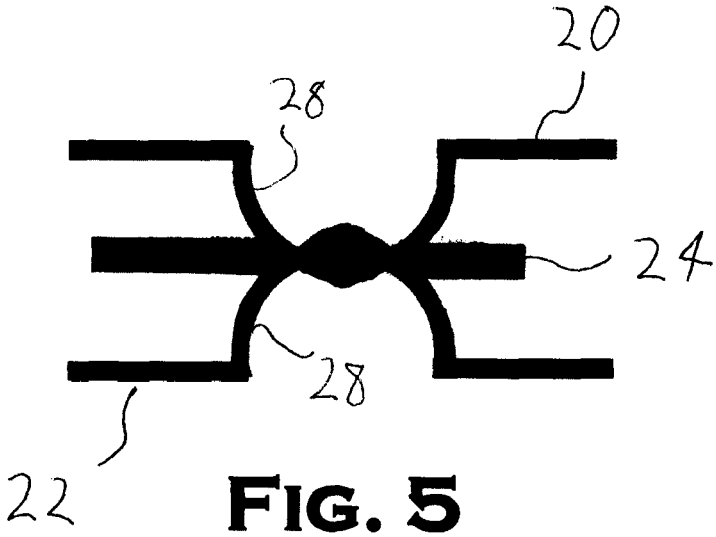
FIG. 5 is a cross sectional view of the shock absorption unit 12 of FIGS. 1-3, showing when a force is applied, shock absorption unit 12 depresses shock absorption face 22 toward face 20, causing respective dimples to juxtapose or contact each other to further disperse forces.
Figure 6:
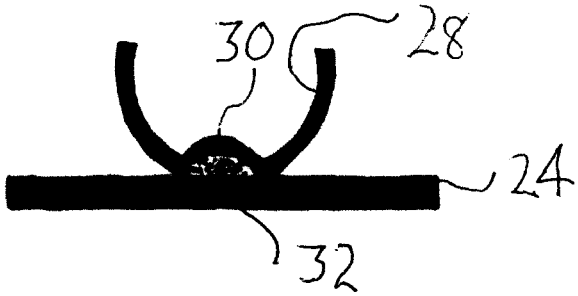
FIG. 6 is a cross sectional view of an individual dimple of the shock absorption unit 12 of FIGS. 1-3.

Referring also to FIGS. 4, 5 and 6, shock absorbing area 26 is characterized by a plurality of shock-absorbing dimples 28.

Referring to FIG. 4, each of the dimples 28 of one side of shell member 16 (front half 20, for example) radially disperses recoil forces throughout the shock absorption area of its shell half as the apex 30 or top of the dimple is compressed. Force is further dispersed as each dimple of one shell half contacts (directly, or indirectly through intervening air bladder 24) its respective, opposing dimple 28 of the other shell half 22 of shell member 16 at that dimple 28's respective apex or top (assuming adequate forces are imparted to cause this degree of surface deflection) to transfer forces for similar dispersion throughout the opposing, dimpled shell half. Of course, the pliable air bladder 24 itself, when installed in preferred embodiments, absorbs and disperses some of the forces to compliment the effect of dimples 28 and maximize the effectiveness of system 10.

Referring to FIG. 5, the apex 30 of the depicted dimple 28 is not compressed nor inverted into itself (the force which would have created this situation is not sufficient, or yet to a level to effect this deformation). In this case, or at this stage, the recoil suppression system 10 or air bladder 24 will fill the void space under impact. However, referring to FIG. 6, under greater impact forces, the apex portion 30 of the inverted dimple 28 collapses inward to dissipate energy in 360 degrees. The area 32 between the shell member 16 and the apex portion 30 is fluid filled in with air when the air bladder 24 expands to the area 32 under impact. After impact the low density polyethylene material will return to its memory shape.

With the rigidity and resilience provided by the use of low density polyethylene, the felt pressure imparted by a firearm stock during recoil is effectively spread and dampened. The absorbing dimples 28 have a "memory" quality wherein the dimples 28 automatically reform to their original shape after collapsing to absorb the shock or recoil.

Referring principally to FIG. 3, shell member 16 is contoured to include a molded curve 34 to allow the user to turn his or her head and neck freely during use. The low profile of the shock absorption unit 12 allows the user or shooter to raise the firearm or weapon to the appropriate position unimpeded.

The slope at the top of unit 12 is parallel with the user's collar, which allows the user to turn his or her head and neck freely. In the preferred embodiment, there is also a slight extension over shoulder (like that pictured in FIG. 3 with the air bladder). That little extension at the tubing entry has some molding over it, which further protects the shoulder.

Figure 7:
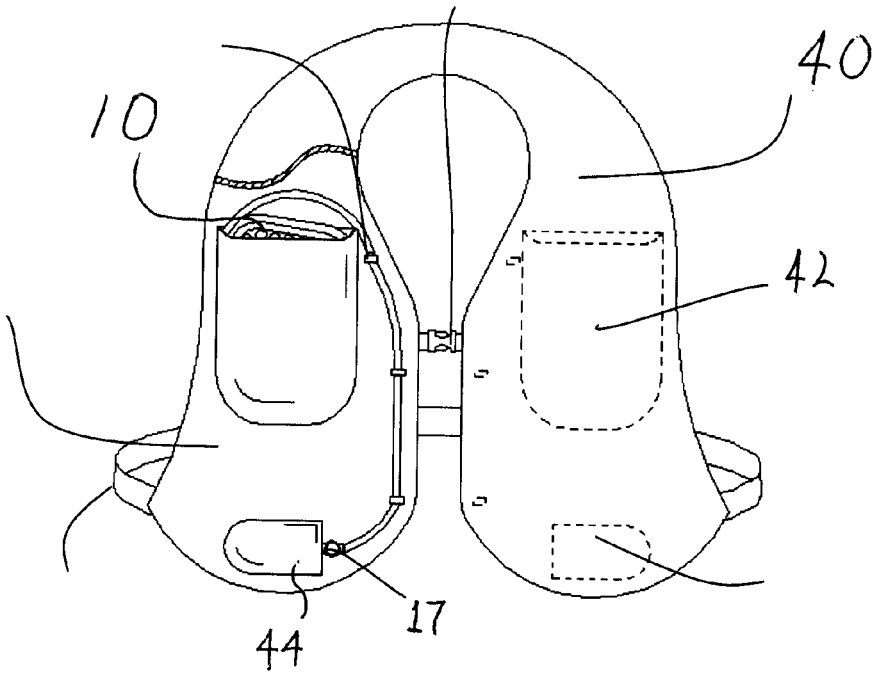
FIG. 7 is a front view of a shooting vest with an embodiment of the present invention incorporated for recoil suppression.
Figure 8:
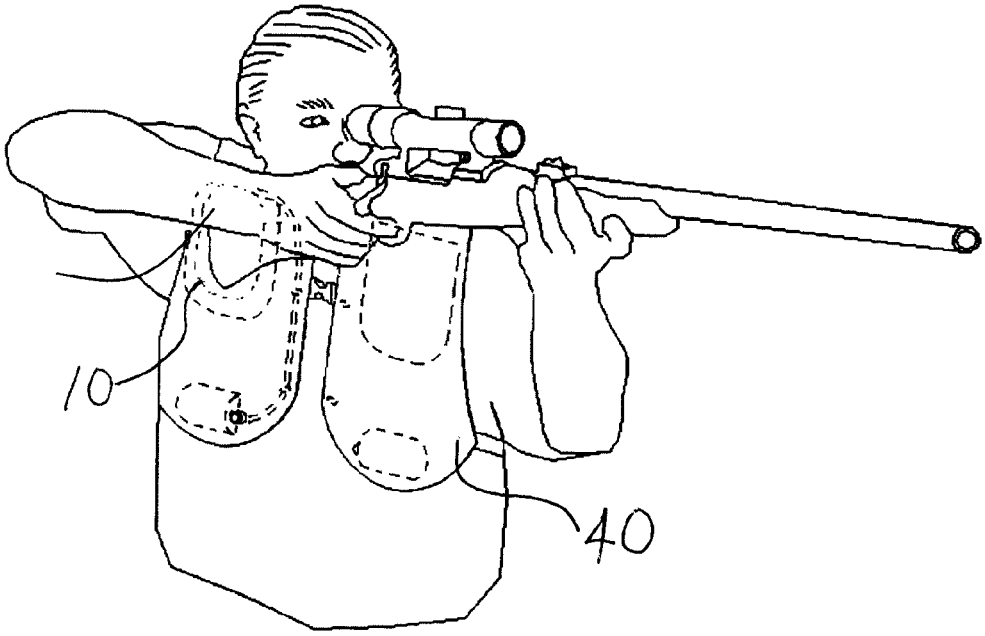
FIG. 8 depicts the vest of FIG. 7 in user.
Figure 9:
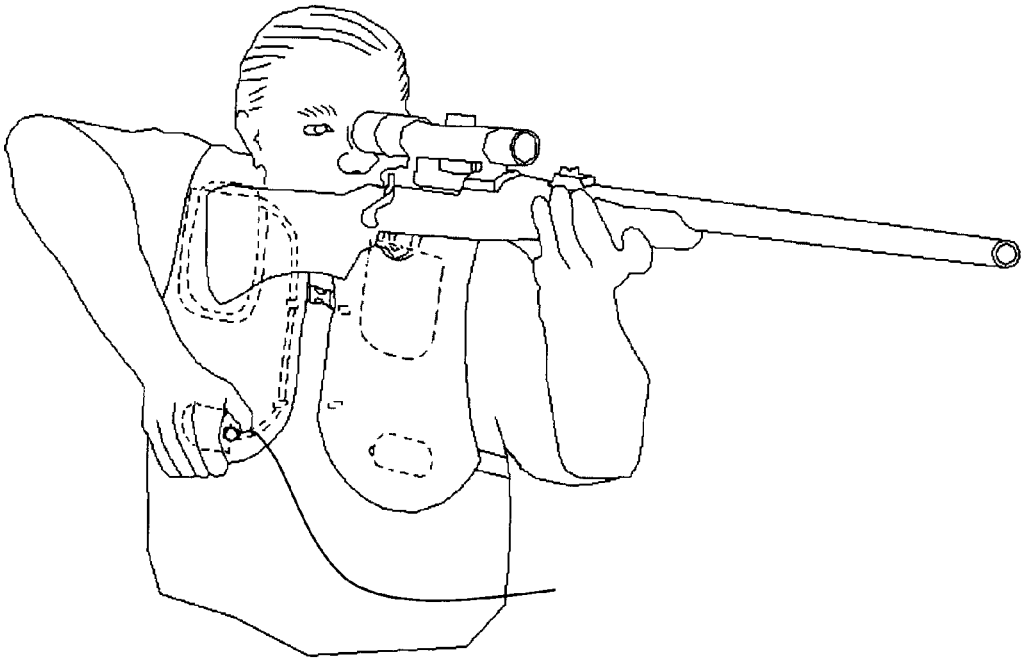
FIG. 9 depicts the vest of FIG. 7, with the user/shooter adjusting the recoil suppression system for varying recoil suppression.

Referring to FIGS. 7-9, embodiments of the present recoil suppression systems are presently envisioned as being optimally used with a shooting vest 40, or similar garment (shirt, jacket, or the like).

Referring to FIG. 7, the front view of the embodiment of the present invention shows that the recoil suppression unit 12 can be worn in a vest, shirt, jacket, or vest-like garment 40. The vest 40 holds the shock absorbing device 10 of the present invention, with the shock absorbing unit 12 and pump 14 being respectively positioned for most convenient use. The vest 40 for use with the present system would be provided with pockets for use by either left or right-handed shooters, with the shock absorption unit 12 being reversed in orientation relative to the user for proper, respective use. Therefore, unit 12 can be positioned on either side, by simply turning the device over, so that the shape conforms to the side used. Vest 40 features left and right pockets 42 for holding the shock absorbing unit 12 in its proper position. The hand pump pocket 44 keeps the pump 14 in an easy to reach area. The push button valve 17 is exposed for easy reach and adjustment.

Referring to FIG. 8, the user places the rifle stock in the shock absorbing area 26 just before firing.

Referring to FIG. 9, the user can manually inflate or deflate air via the pump 14 into the shock absorbing unit 12, thus adjusting the desired recoil dampening, while wearing the unit 12 in the vest, shirt, jacket, or vest-like garment 40, and holding the firearm. When the garment is provided with suitably positioned pockets, such use will assure proper positioning of the shock absorption unit 12, as well as convenient positioning of any remotely positioned pump 14.

It should be understood that, while use of the present recoil suppression system has been discussed in the context of firearm recoil suppressions, alternative uses and embodiments will fall within the scope of the present invention. Because the present design and structure of shock absorption until unit 12 is, in an extraordinarily economical fashion, uniquely capable of dispersing "jarring" forces, of which firearm (rifle or shotgun) recoil is only one example, the potential, beneficial implementations of the present invention are wide and varied. Even within the firearms context, alternative embodiments may involve use in a glove, for recoil suppression for hand guns. Further still, however, embodiments of the invention may be incorporated into systems for protecting delicate items during shipping, for protecting trauma patients during transport, for protecting delicate instruments or equipment during use aboard moving vehicles or aircraft, and so on, and even for use in sports protective or industrial protection pads, helmets and devices. Therefore, although the invention has been described with reference to specific embodiments, this description is not meant to be construed in a limited sense. It is contemplated that the appended claims will cover such modifications that fall within the scope of the invention.

I claim:

1. A shock absorption system, comprising:

a shell member constructed of a substantially flexible and resilient material, said shell member having first and second, substantially oppositely oriented, shock absorption faces, said first and second shock absorption faces being supported by an intervening margin structure which, with said first and second shock absorption faces, collectively define an interior shell member space, each of said shock absorption faces having an inwardly projecting dimple, said dimple on said first shock absorption face and said dimple on said second shock absorption face being respectively, relatively positioned and oriented whereby their respective, inwardly projecting apices are substantially aligned and oriented whereby, when a force is imparted to said first shock absorption face sufficient to depress said first shock absorption face and move its respective dimple toward the opposing said dimple of said second shock absorption face, across said interior shell member space, respective said apices come into closer juxtaposition, or into contact, depending on the magnitude of such force.

2. The system of claim 1, further comprising a bladder member positioned within said interior shell member space, said bladder member having inflation means for facilitating reversible inflation of said bladder member.

3. The system of claim 1, further comprising enclosure means, sized and shaped for receiving said shell member into a portion thereof, and for maintaining said shell member in a position for dissipating impact or shock forces from a moving body placed in juxtaposition to the portion of said enclosure means which maintains said shell member.

4. The system of claim 3, wherein said enclosure member is a shooting garment, and the moving body is a firearm.

5. The system of claim 2, further comprising enclosure means, sized and shaped for receiving said shell member into a portion thereof, and for maintaining said shell member in a position for dissipating impact or shock forces from a moving body placed in juxtaposition to the portion of said enclosure means which maintains said shell member.

6. The system of claim 5, wherein said enclosure member is a shooting garment, and the moving body is a firearm.

7. A recoil suppressing device comprising:

a shell having a first surface and a second surface, said first and second surfaces defining a plurality of depressions, each of said depressions of said first surface is oriented substantially opposite a corresponding depression of said second surface, whereby the oppositely oriented depressions come into contact upon application of a force to said shell; and a chamber disposed between said first and second surfaces, said chamber configured to accommodate a fluid.

8. The device of claim 7, further comprising a pump attached to said chamber and configured to adjust the volume of fluid within said chamber.

9. The device of claim 8, wherein said pump is a manual pump.

10. The device of claim 8, wherein said pump is an electric pump.

11. The device of claim 8, further comprising a valve in fluid communication with said pump and said chamber and configured to control the pressure of said fluid in said chamber.

12. The device of claim 7, wherein said shell is constructed of low density polyethylene material.

13. The device of claim 7, wherein said shell is configured to deform upon application of a force, and then return to substantially its original shape after the force is removed.

14. The device of claim 7, wherein said shell has a thickness in the range of about 0.02 inch to 0.04 inch.

15. The device of claim 7, wherein said first and second surfaces of said shell are formed discretely from one another and bonded together.

16. The device of claim 7, wherein said first and second surfaces of said shell are integrally formed by a molding process.

17. The device of claim 7, further comprising ribs attached to said shell and configured to provide rigidity to said shell.

18. The device of claim 7, wherein at least one of said plurality of depressions is a half-sphere directed inwardly from said first or second surface toward said chamber.

19. The device of claim 7, wherein at least one of said plurality of depressions is configured to at least partially collapse upon the application of a predetermined force against said shell.

20. The device of claim 19, wherein said at least one depression is configured to return to its original shape after the predetermined force has been removed.

21. The device of claim 7, wherein said shell is configured to cover a portion of a human chest or shoulder, or both a human chest and shoulder, and said shell is contoured to allow free movement of a user's head and neck during use.

22. The device of claim 7, wherein said device is configured to be used with a shooting vest, shirt, or jacket.

23. The device of claim 7, wherein said fluid is a gas.

* * * * *